United States Patent [19]

James

[11] 3,981,484

[45] Sept. 21, 1976

[54] LIFTING APPARATUS

[76] Inventor: David Richard James, Hasfield, England

[22] Filed: June 21, 1974

[21] Appl. No.: 481,866

[30] Foreign Application Priority Data

June 21, 1973 United Kingdom ..... 29475/73

[52] U.S. Cl. ..... 254/148; 5/81 R; 5/88; 214/75 R

[51] Int. Cl.[2] ..... B66D 1/00

[58] Field of Search ..... 254/148, 4 R; 297/347; 5/81, 83, 84, 88, 86, 87, 89; 214/1 A, 730, 620, 671, 75 R; 187/1 R, 9 R, 17

[56] References Cited

UNITED STATES PATENTS

| | | | |
|---|---|---|---|
| 730,770 | 6/1903 | Hoyer | 5/84 |
| 2,664,142 | 12/1953 | Scheuerman et al. | 5/81 R |
| 2,930,499 | 3/1960 | Landen | 214/75 R |
| 3,172,500 | 3/1965 | Dolphin et al. | 214/730 |
| 3,182,826 | 5/1965 | Mutto | 214/75 R |
| 3,310,816 | 3/1967 | James et al. | 5/84 |
| 3,694,829 | 10/1972 | Bakker | 5/81 R |
| 3,711,877 | 1/1973 | Averill | 5/81 R |
| 3,757,977 | 9/1973 | Bradi et al. | 214/620 |

FOREIGN PATENTS OR APPLICATIONS

| | | | |
|---|---|---|---|
| 1,570,522 | 7/1969 | France | 214/671 |
| 6,514,317 | 6/1966 | Netherlands | 214/730 |
| 413,722 | 12/1966 | Switzerland | 214/730 |
| 990,992 | 5/1965 | United Kingdom | 214/670 |

*Primary Examiner*—L. J. Paperner
*Assistant Examiner*—Ross Weaver
*Attorney, Agent, or Firm*—Cushman, Darby & Cushman

[57] ABSTRACT

An invalid hoist is provided for raising and lowering infirm and disabled persons while rigidly supported at the free end of an arm and of the type comprising an upstanding column and a patient support structure which projects from the column. To facilitate use of the hoist for hydrotherapy purposes, the support structure comprises a load attachment member adjacent a lower end of which a patient support member is rigidly attachable and which is slidable in a vertical plane for attachment purposes, the attachment member being capable of arcuate movement in a horizontal plane about a pivot axis offset from that plane towards, at or beyond the column.

12 Claims, 4 Drawing Figures

LIFTING APPARATUS

This invention relates to lifting apparatus or so-called "invalid hoists" for raising and lowering infirm and disabled persons while rigidly supported at the free end of the arm and of the type comprising an upstanding column and a patient support structure which projects from the column, the patient being supported at the end of the support structure remote from the column.

Invalid hoists currently in use have a support structure comprising a lifting arm, i.e. an arm which is itself raised and lowered, controlled by means of an elevating mechanism associated with the column, and it is known to have a rigid patient support member, such as a seat or a stretcher, rigidly attached in a predetermined position at the end of the arm. There is a growing requirement for invalid hoists usable for hydrotherapy purposes to provide a rigid cantilevered lift reaching over the side of swimming and hydrotherapy pools or tanks and which must rotate the load between a position beside the water and a position above the water.

The adaptation of existing types of invalid hoists to hydrotherapy purposes has posed considerable problems, due partly to the long cantilevered reach required and to the fact that the same basic design should desirably be applicable to sunken pools, partially sunken pools and hydrotherapy tanks. The hoists which have so far been employed for hydrotherapy have all suffered from more or less serious disadvantages, and the object of the invention is to provide lifting apparatus particularly adaptable as a hydrotherapy hoist and which materially solves the problems of existing hoists, while providing a compact and efficient construction which can be fitted without structural modification of the building in which it is to be used.

According to one aspect of the invention an invalid hoist comprises an upstanding column, a load support structure projecting from the column and an elevating mechanism whereby a load supported at the end of the support structure remote from the column can be raised and lowered in a vertical plane, wherein the support structure comprises an arm projecting from the column and a load attachment member adjacent a lower end of which a patient support member is rigidly attachable and which is slidable or adjustable so as to be capable of rectilinear movement in said vertical plane relative to the arm, with the attachment member capable of arcuate movement in a horizontal plane about a pivot axis offset from that member towards, at or beyond the column.

Preferably the rectilinear movement of the load attachment member relative to the arm provides the lift with the arm remaining at a constant height during raising and lowering of the load, although the arm may be adjustable with respect to the column to provide a vertical shift of the lifting range. The load attachment member preferably comprises a tubular guide defining the path of lifting movement and providing an internal track for a carriage of the elevating mechanism, which carriage is fixed to the free end of the arm. A control member of the elevating mechanism is desirably mounted on the column itself, or at the side of the arm adjacent the column, and this control member may be a winding handle for manual operation of the mechanism.

Thus, according to another aspect of the invention an invalid hoist comprises an upstanding support column, a support arm projecting from the column, a lifting member mounted at the end of the arm remote from the column and adapted to support a load with a patient support member rigidly attached to the lifting member, and an elevating mechanism operative to raise and lower the lifting member along a linear path relative to the arm and controlled by an operating member accessible to an operator standing alongside the column, said linear path lying in a vertical plane and being defined by guide means adjacent said end of the support arm which can be swung round with the load along an arcuate path about a vertical pivot axis at or adjacent the column.

It will be appreciated that the "load" lifted by the load support structure will consist of the patient and a rigid patient support member, such as a seat or a stretcher, which is directly attached to said load attachment member. The patient support member is desirably rigidly attached to the load attachment member in such manner that the support member is itself cantilevered from the attachment member, and the hoist may include a detachable rigid patient support member, for example a rigid seat or stretcher for a disabled person.

When the hoist includes the aforesaid guide/carriage combination, the elevating mechanism may include a chain or cable drive therefor with the chain or cable passing along the arm and around a sprocket or cable drum turned by the winding handle. It will be appreciated that the guide/carriage arrangement as described may be reversed, with the tubular guide fixed at the end of the arm and the carriage fixed to the load attachment member. The tubular guide, when the carriage is as preferred fixed to the arm, may have a "hook-on" attachment point for the support member and a reaction abutment for that member spaced below the attachment point.

The column may be rotatably mounted on a floor mounting plate or in a floor socket for static installation, for example alongside a swimming pool, with the mounting so constructed as to meet the cantilever loading imposed upon it by the lift and the applied load. However, the column may be non-rotatable and the support structure rotatably mounted on the column; in the first case the apparatus including the column may be detachable when not in use by lifting out of the floor plate or socket, and in the second case the support structure may be detachable from the column. Alternatively, the column may be mounted on a wheeled base provided as necessary with counter-balancing or counter-reacting means to provide stability in respect of the cantilever forces.

As has been mentioned, the arm, when the lift occurs at the end of the arm, may be adjustable with respect to the column, and to this end it may be invertible or have an invertible portion which is inclined in a vertical plane. Thus invertion of the arm, or the portion thereof, provides a different mean height position for the patient support member without affecting the lifting range.

The invention will now be further described with reference to the accompanying drawings which illustrate, by way of example, a schematic embodiment and a practical structural development thereof in the form of a hoist for floor mounting alongside a swimming or hydrotherapy pool. In the drawings.

Figure 1:
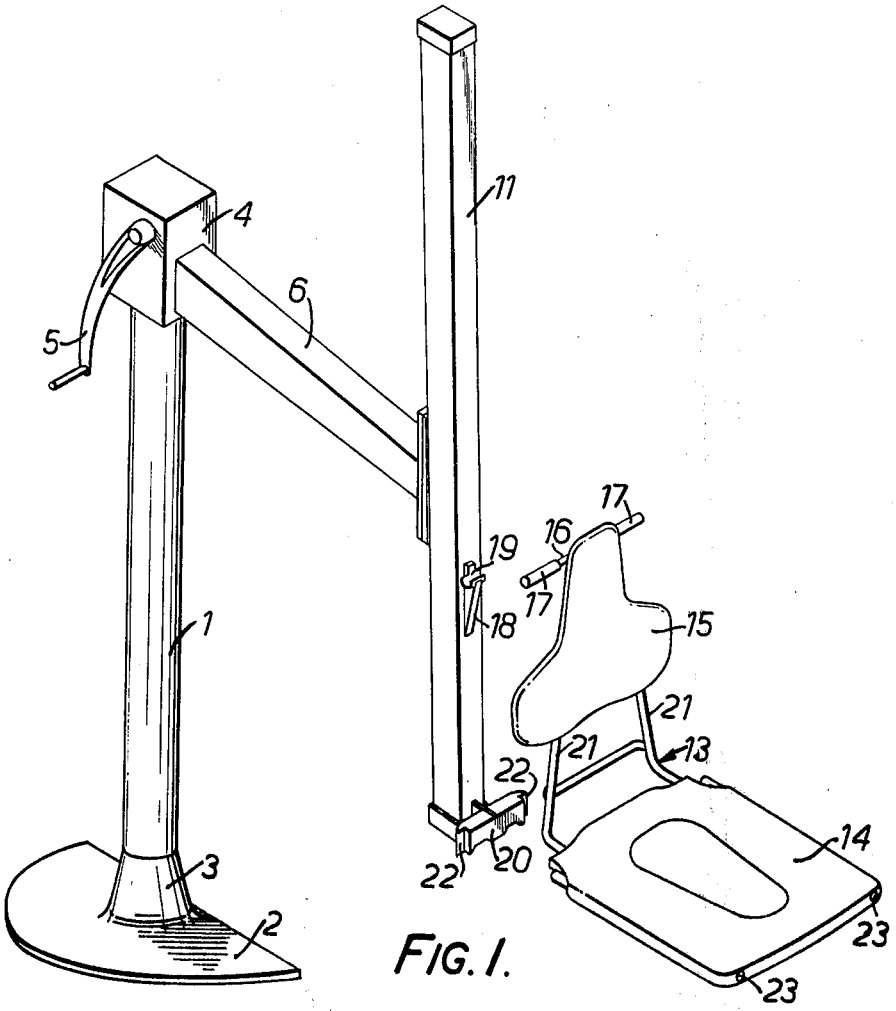
FIG. 1 is a perspective view of the schematic arrangement.
Figure 2:
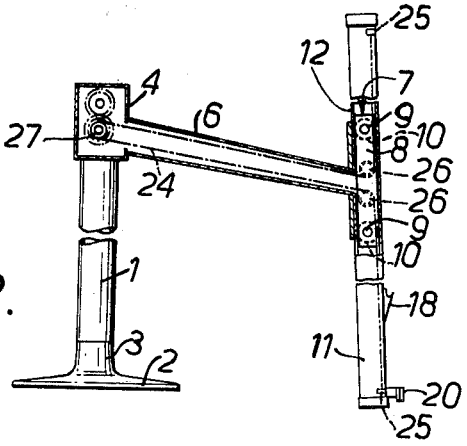
FIG. 2 is a corresponding side view, partly in section.

Referring first to the schematic of FIGS. 1 and 2, a round tubular column 1 is mounted for rotation about a vertical longitudinal axis in a floor plate 2 for bolting to the floor. The plate 2 is of generally semi-circular shape with a cast-in boss 3 in which low friction bearings for the column 1 are housed. In a modification, the column 1 is adapted to be mounted in a bearing socket recessed into the floor. At the upper end the column 1 terminates in a rectangular gearbox 4, a winding handle 5 being positioned at one side of the gearbox 4 at a convenient height for manual operation.

A hollow square-section cantilever arm 6 projects downwardly from the gearbox 4 in a horizontal plane, at an inclination of about 10° to the horizontal. The arm 6 can be inverted so that it is inclined upwardly at the same angle, to increase the mean height of the lifting range for use with an above ground level hydrotherapy tank instead of a sunken pool. A wheeled carriage 7 mounted on the free end of the arm 6 comprises a bearing block 8 disposed substantially vertically and having at its upper and lower ends laterally disposed pins 9 on which pairs of wheels 10 are respectively mounted.

The carriage 7 runs within a square-section tubular guide 11 providing a load attachment or lifting member, with the wheels 10 acting as bearings as the guide 11 is raised and lowered with the load. The side wall of the tubular guide 11 adjacent the arm 6 is centrally slotted at 12 to provide running clearance for the connection between the bearing block 8 and the arm 6. It will be appreciated that the wheeled carriage 7 could be replaced by any other suitable bearing and guide arrangement which locates the axis of the guide tube 11 throughout the range of lifting movement thereof.

Towards the bottom end the guide tube 11 has means for attachment of a detachable support seat frame, i.e. a legless chair, or a stretcher unit. A chair 13 is shown in FIG. 1 in a position close to but detached from the tube 11. The chair 13 when fitted is itself cantilevered from the tube 11, and it has a moulded plastics seat 14 and a moulded plastics backrest 15 which is fixed to a rear frame portion formed as an A-frame. An upper cross member 16 of this frame is extended on both sides to support moulded handgrips 17 and, when the chair is attached, engages a hook-on attachment point 18 on the tube 11. This attachment point provides an upwardly facing recess 19 into which the frame cross member 16 can be hooked. The chair attachment means also comprise a reaction abutment plate 20 at the bottom end of the guide tube 11 and against which the back frame portion of the seat 13 rests, with side frame members 21 respectively engaging side edge recesses 22 in the abutment plate 20. Thus the attachment point 18 and the reaction plate 20 cooperate to provide a cantilevered reacting attachment for the patient support means, either for the seat 13 or for a stretcher attachment.

The moulded seat portion 14 has longitudinal bores 23 which enables it to be fitted on to a mobile trolley (not shown) when detached from the guide tube 11. This enables the patient to be wheeled to and from the hydrotherapy pool, the handgrips 17 being used for propulsion and guidance, and the patient can remain seated during attachment and detachment of the seat 13 which he need not leave at any time during the treatment session. For additional patient support the chair 13 may have rigid side arms.

In addition to the wheeled carriage 7 and gearbox 4 the elevating mechanism comprises a precision roller chain (or cable) 24, the ends of which are respectively attached at points 25 to the top and bottom ends of the guide tube 11 on the side wall thereof remote from the column 1. The ends of the chain 24 respectively run close to the side wall to upper and lower idler sprockets (or pulleys) 26 on the bearing block 8, from whence the central loop of the chain 24 passes through the tubular arm 6 and around a drive sprocket (or cable drum) 27 within the gearbox 4. To guard against corrosion the chain or cable is of stainless steel, and in the case of a cable the centre point is for safety purposes anchored to the cable drum 27, which accommodates a sufficient number of turns of the cable 24 to allow for this. The hoist generally is manufactured from suitable materials and/or treated to prevent corrosion in the damp conditions in which it operates, and oil or grease lubrication is wherever possible avoided to prevent contamination of the pool or tank.

Figure 3:
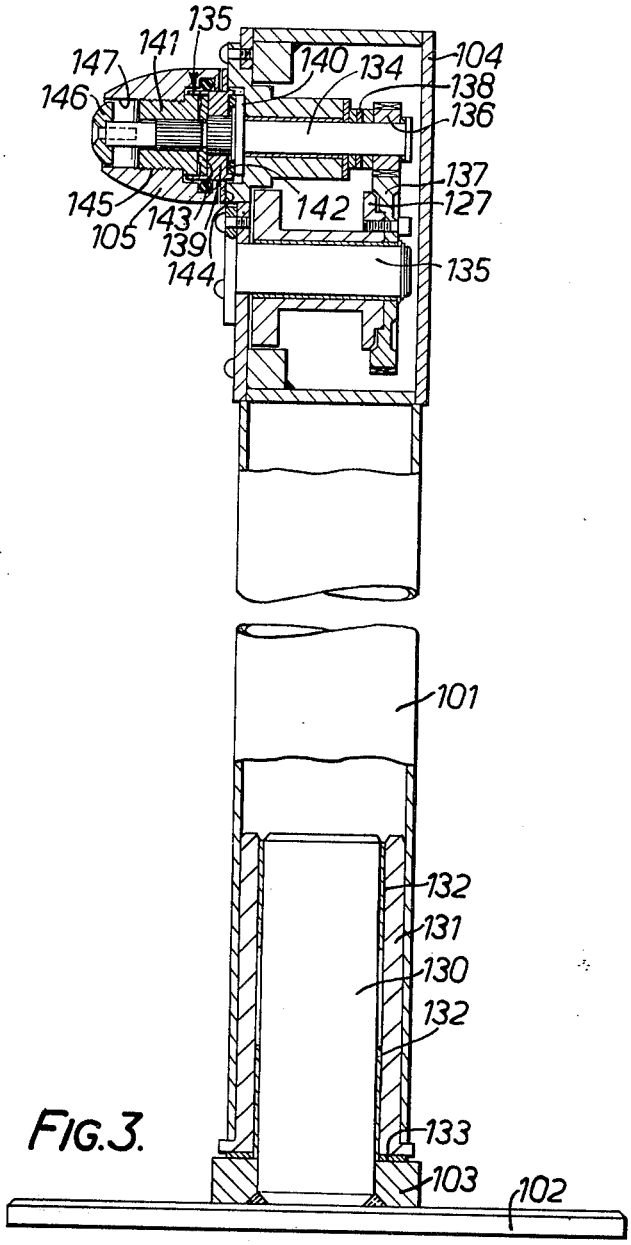
FIG. 3 is a partly-sectioned front view of a column of the practical development.
Figure 4:
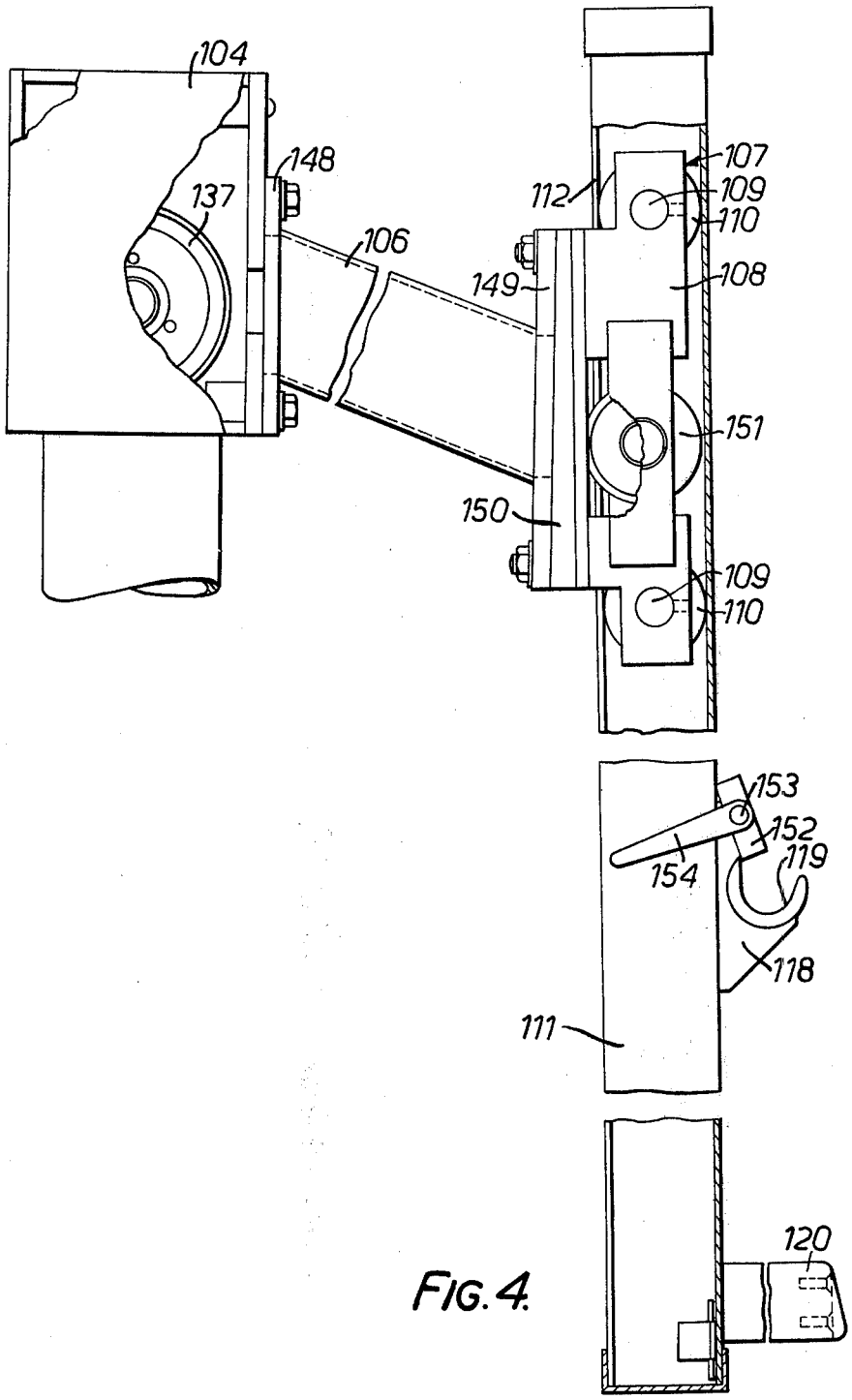
FIG. 4 is a partly-sectioned detail view of the development and corresponding to schematic FIG. 2.

Referring now to the practical structural embodiment of FIGS. 3 and 4, these figures wherever appropriate utilise for corresponding parts the same reference numerals as FIGS. 1 and 2 but increased by "100". The boss 103 of the mounting plate 102 supports a column location pin 130 on which the column 101 turns. A sleeve 131 fitted into the lower end of the column is rotatably supported on the pin 130 through bearings 132, and a thrust bearing washer 133 is positioned between the upper end of the boss 103 and a bottom end flange on the sleeve 131.

The winding handle 105 is mounted on an input shaft 134 of the gearbox 104 through a ratchet brake arrangement 135 which holds the guide tube 111 and the load against gravity in any position throughout the lifting range. The elevating mechanism uses a stainless steel driving cable (not shown), the cable drum 127 being rotatably mounted on a spindle 135 fixed in the gearbox 104 below and parallel to the input shaft 134. The drum 127 is driven through a spur gear arrangement to reduce the effort required to operate the hoist at the winding handle 105, a primary spur gear 136 mounted on the shaft 134 meshing with a secondary spur gear 137 bolted to one end of the cable drum 127. The spur gear 136 can turn on the gearbox shaft 134 but is driven from the shaft through a load limiting friction clutch 138 which thus avoids overloading of the elevating mechanism, particularly of the cable, at the end of the lifting range or if too heavy a load is applied.

The ratchet brake arrangement 135 comprises a ratchet wheel 139 which is normally fast with the shaft 134, being clamped up between a flange 140 on the shaft and an internally threaded insert 141 of the winding handle 105. The ratchet wheel 139 is clamped through friction discs 142 and 143 respectively disposed on opposite sides of the wheel 139, and a fixed ratchet plate 144 engages the ratchet wheel 139 to hold the elevating mechanism, and thus retain the load, against gravity at any desired height thereby preventing the load from over-running the elevating mechanism.

The friction brake operates in the following manner. Turning the winding handle 105 clockwise to raise the load tightens the ratchet wheel 139 on the shaft 134, the handle insert 141 and the shaft 134 having righthanded cooperating threads at 145. The ratchet plate 144 allows the ratchet wheel 139 to turn in the load raising direction, but engages the ratchet teeth to prevent return movement while the ratchet wheel 139 is fast with the shaft 134. When the handle 105 is turned anti-clockwise to lower the load it cannot turn the shaft 134 as the ratchet wheel 139 is held by the fixed plate 144, and thus the handle 105 unscrews on the thread 145. As soon as it has unscrewed through a small angle the grip on the ratchet wheel 139 is relaxed sufficiently for the shaft to turn, under the gravitational effort of the load, within the ratchet wheel 130. This it does until it has taken up the unthreading movement of the handle 105 when the ratchet wheel 139 is again gripped and further movement prevented. Thus the lowering movement proceeds on a "stick-slip" basis, which with the brake design illustrated proceeds so smoothly as to be imperceptible to the operator or the patient. To prevent the handle 105 being unscrewed off the shaft 134, at the bottom end of the lifting range it is held captive by an end cap 146 fixed to the end of the shaft 134. This end cap is partly recessed within a bore 147 in the boss of the handle 105, an appropriate axial clearance being left between the cap 146 and the handle insert 141.

To allow inversion of the arm 106, it is detachable at both ends from the gearbox 104 and the carriage 107, respectively. To this end the arm 106 has end mounting flanges 148 and 149, respectively, which bolt to the gearbox 104 and the connection for the wheeled carriage 107. It has been found in practice that a slightly upwardly and backwardly inclined position of the guide tube 111 is desirable, as shown in the drawings, and so that this can be achieved with the invertible arm 106 and with both flanges 148 and 149 disposed in parallel vertical planes, a taper packing piece 150 is positioned between the flange 149 and the carriage 107.

The two runs of the lifting cable in the construction of FIGS. 3 and 4 respectively pass around two independent idlers mounted side by side on a common spindle on the carriage block 108, instead of the spaced separate idlers 26 shown in FIG. 2. One run of the cable passes over the top of the idler 151 down to the bottom end of the tube 111, whereas the other run passes below the other idler (not shown) and then upwardly to the upper end of the tube 111.

The only other significant change shown in FIGS. 3 and 4 is the provision of a gravity-urged safety latch for the attachment point 118 of the patient support member. This latch comprises a latch member 152 which turns about a horizontal axis 153 and is urged to the latching position shown in FIG. 4 by the weight of a lever portion 154. In the latching position it extends above the recess 119, thereby positively retaining the attached patient support member. To remove that member the catch is turned by lifting the lever 154, thereby allowing the seat 13 or stretcher to be unhooked. A spring-urged latch may alternatively be employed.

It will be appreciated that in both constructions a single run of chain or cable may be employed driven at one end with the other end attached to the bottom of the guide tube 11 or 111, instead of the central driven chain or cable illustrated. In this case gravity is relied on to produce lowering movement of the patient.

When not in use the column 1 or 101, with the structure mounted thereon, can be removed by lifting of the floor plate 2 or 102 and stored out of the way. This is particularly advantageous when the apparatus is used at a public swimming pool which is made available at specific times for hydrotherapy sessions. In a modification, the column is non-rotatably fixed to the floor, the structure supported from the column being removable therefrom when not in use and when fitted rotatable on the column. In another modification the column is rotatably mounted but the patient support structure, including the arm, can be lifted off the column for storage when not in use.

What is claimed is:

1. An invalid hoist comprising an upstanding column, a load support structure projecting from the column and an elevating mechanism whereby a load supported at the end of the support structure remote from the column can be raised and lowered in a vertical plane, wherein the support structure comprises an arm projecting from the column at an angle inclined to the horizontal, which arm or a portion thereof is invertible to provide two alternative adjusted positions in which the arm is respectively inclined below and above the horizontal, and a load attachment member adjacent a lower end of which the load is rigidly attachable and which is slidable so as to be capable of rectilinear load-lifting movement in said vertical plane relative to the arm with the latter remaining at a constant height during raising and lowering of the load, with the attachment member capable of arcuate movement in a horizontal plane about a pivot axis offset from that member.

2. A hoist according to claim 1, wherein the invertible arm or portion thereof has vertical end attachment flanges by which it is bolted in either of said adjusted positions.

3. An invalid hoist comprising:

an upstanding support column, a support arm projecting from said column, a guide means rigidly attached to said support arm adjacent the end of said support arm remote from said upstanding column, an elongated rigid lifting member positioned adjacent said guide means and being movable with respect thereto, said lifting member being adapted to support a load with a patient support member rigidly attached thereto adjacent a lower end thereof, said guide means defining a linear path lying in a vertical plane along which said lifting member is movable and said guide means being relatively short along the direction of said linear path compared to the length of said lifting member, and an elevating mechanism operative to raise and lower the lifting member along said linear path relative to said arm, said elevating mechanism including a sprocket or cable drum rotatably fixed with respect to said support column and said support arm, means for turning said sprocket or cable drum, and a chain or cable secured at each end thereof adjacent the top and bottom, respectively, of said lifting member and passing along said support arm and around said sprocket or cable drum, wherein said support arm can be swung around with the load traversing an arcuate path about a vertical pivot axis at or adjacent said support column.

4. The invalid hoist of claim 3 wherein said elevating mechanism further comprises an idler sprocket or pulley rotatably fixed with respect to said guide means, said chain or cable passing from the respective ends thereof about said idler sprocket or pulley, along said support arm and around said sprocket or cable drum.

5. The invalid hoist of claim 3 further comprising idler sprockets or pulleys rotatably fixed with respect to said guide means, said chain or cable passing about one of said idler sprockets or pulleys, along said support arm, around said sprocket or cable drum, along said support arm and over the other of said idler sprockets or pulleys.

6. The invalid hoist of claim 4 wherein said support column is rotatably mounted on a floor mounting plate.

7. The invalid hoist of claim 5 wherein said column is rotatably mounted on a floor mounting plate.

8. The invalid hoist of claim 4 wherein said means for turning said sprocket or cable drum is a winding handle for manual operation of said mechanism.

9. The invalid hoist of claim 4 wherein said patient support member is rigidly attached to the elongated lifting member so that said patient support member is cantilevered from said lifting member.

10. The invalid hoist of claim 4 wherein said elongated lifting member has a hook-on attachment point for said patient support member and a reaction abutment for said patient support member spaced below said attachment point.

11. The invalid hoist of claim 10 wherein said support arm is of tubular construction and said chain or cable is housed within said support arm.

12. The invalid hoist of claim 11 wherein said support arm projects from said support column at an angle inclined to the horizontal, said arm being invertible to provide two alternative adjustment positions in which said arm is respectively inclined above and below the horizontal.

* * * * *